US008739491B2

(12) United States Patent
Maisch

(10) Patent No.: US 8,739,491 B2
(45) Date of Patent: Jun. 3, 2014

(54) THIN-WALLED, COLD FORMED LIGHTWEIGHT STRUCTURAL PROFILE ELEMENT AND METHOD FOR PRODUCING SUCH A PROFILE ELEMENT

(75) Inventor: Christof Maisch, Gaggenau (DE)

(73) Assignee: Protektorwerk Florenz Maisch GmbH & Co. KG, Gaggenau (DE)

( * ) Notice: Subject to any disclaimer, the term of this patent is extended or adjusted under 35 U.S.C. 154(b) by 129 days.

(21) Appl. No.: 13/498,382

(22) PCT Filed: Sep. 27, 2010

(86) PCT No.: PCT/EP2010/005891

§ 371 (c)(1),
(2), (4) Date: May 31, 2012

(87) PCT Pub. No.: WO2011/038879

PCT Pub. Date: Apr. 7, 2011

(65) Prior Publication Data

US 2012/0240508 A1 Sep. 27, 2012

(30) Foreign Application Priority Data

Oct. 1, 2009 (DE) ..... 10 2009 047 958
Oct. 2, 2009 (DE) ..... 10 2009 048 152
Jul. 7, 2010 (DE) ..... 10 2010 026 320

(51) Int. Cl.
*E04B 2/00* (2006.01)
*E04C 3/00* (2006.01)
*E04C 2/34* (2006.01)

(52) U.S. Cl.
USPC ..... 52/588.1; 52/831; 52/481.1

(58) Field of Classification Search
CPC ..... E04C 2/00; E04C 2/30; E04C 2/32; E04C 2/34; E04C 2/38; E04C 2003/0439; E04C 2003/0413; E04C 3/07; E04C 3/08; E04B 2001/2472
USPC ..... 52/588.1, 481.1, 481.2, 831, 836, 838, 52/840, 844, 846, 854
See application file for complete search history.

(56) References Cited

U.S. PATENT DOCUMENTS 1,741,423 A * 12/1929 Lachman ..... 52/636

(Continued)

FOREIGN PATENT DOCUMENTS

CH 381 838 9/1964

(Continued)

OTHER PUBLICATIONS

Translation of German Search Report dated Jun. 14, 2011 relating to DE 10 2010 026 320.6.

(Continued)

*Primary Examiner* — Mark Wendell
(74) *Attorney, Agent, or Firm* — Gifford, Krass, Sprinkle, Anderson & Citkowski, P.C.

(57) ABSTRACT

The invention relates to a thin-walled, cold-formed profile element, in particular a structural profile, for example a drywall construction, facade, plaster, screed, tile or cable carrier profile or a shelf or drain rail. The profile element has an elongated profile body, in particular metallic or consisting of plastic, in which a multiplicity of openings is formed. The profile body comprises at least two separately constructed longitudinal sections, each longitudinal section comprising a serpentine longitudinal edge. The longitudinal sections each comprise an elongated section and a plurality of connecting sections projecting laterally beyond the elongated section, which are bordered by the serpentine longitudinal edge. The connecting sections of the one longitudinal section face the connecting sections of the other longitudinal section and are in each case welded to the latter edge to edge or joined to one another along curved abutting edges. At least in some sections, the openings are bordered by sections of the serpentine longitudinal edges. Formed in the longitudinal sections are reinforcing beads running in the longitudinal direction of the longitudinal sections and also reinforcing beads running transversely thereto, the reinforcing beads running transversely being connected to the reinforcing beads running in the longitudinal direction, and the reinforcing beads running transversely extending into the connecting sections. The invention further relates to a method for producing such a profile element.

19 Claims, 11 Drawing Sheets

(56) References Cited

U.S. PATENT DOCUMENTS

Figure 1:
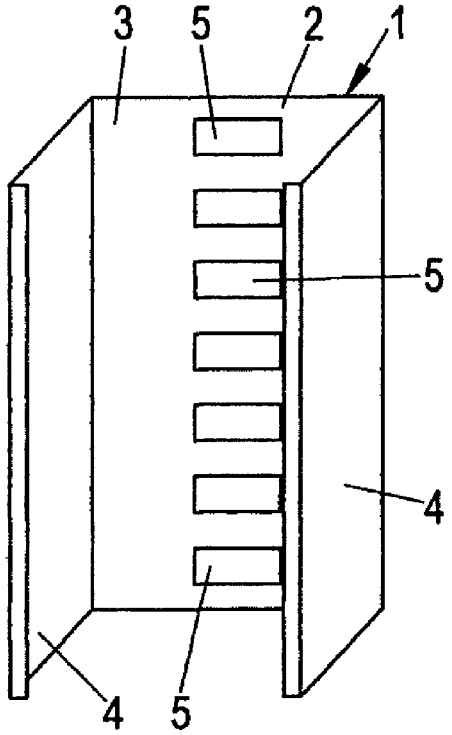

| | | | | |
|---|---|---|---|---|
| 2,002,044 | A | 5/1935 | Rothenstein | |
| 2,990,038 | A | 6/1961 | Diamond | |
| 3,874,051 | A | 4/1975 | Malik | |
| 4,071,995 | A | 2/1978 | Farmer | |
| 4,152,873 | A | 5/1979 | Burke | |
| 5,524,410 | A | 6/1996 | Menchetti | |
| 5,525,410 | A | 6/1996 | Hansen | |
| 5,588,273 | A * | 12/1996 | Csagoly | 52/634 |
| 5,661,881 | A | 9/1997 | Menchetti | |
| 5,669,197 | A * | 9/1997 | Bodnar | 52/636 |
| 7,797,908 | B2 * | 9/2010 | Keys | 52/846 |
| 7,908,811 | B2 * | 3/2011 | Ubilla | 52/481.1 |
| 2008/0115445 | A1 * | 5/2008 | Keys | 52/634 |
| 2009/0100794 | A1 | 4/2009 | Holmes et al. | |
| 2013/0174511 | A1 * | 7/2013 | Anderson et al. | 52/836 |

FOREIGN PATENT DOCUMENTS

| | | | |
|---|---|---|---|
| CH | 687 091 | A5 | 9/1996 |
| DE | 449 632 | C1 | 9/1927 |
| DE | 1 484 301 | A1 | 1/1969 |
| DE | 1 484 305 | A1 | 1/1969 |
| DE | 2 303 466 | B1 | 7/1974 |
| DE | 2 305 371 | A1 | 8/1974 |
| DE | 24 33 142 | A1 | 1/1976 |
| DE | 10 2007 053 471 | A1 | 5/2009 |
| DE | 10 2009 048 152 | A1 | 4/2011 |
| EP | 0 324 206 | | 4/1993 |
| EP | 1 760 215 | A1 | 3/2007 |
| EP | 1 961 887 | A1 | 8/2008 |
| EP | 1 961 887 | A1 | 8/2008 |
| EP | 1 961 887 | B1 | 8/2008 |
| FR | 706311 | A | 6/1931 |
| FR | 1.234.371 | A | 10/1960 |
| FR | 2 301 653 | A1 | 9/1976 |
| GB | 680022 | A | 10/1952 |
| JP | 56071680 | A | 6/1981 |
| NL | 9300520 | A | 10/1994 |
| SU | 1231170 | A1 | 5/1986 |
| WO | WO-86/06431 | A1 | 11/1986 |
| WO | WO-2004/055289 | A1 | 7/2004 |
| WO | WO-2007/042525 | A2 | 4/2007 |
| WO | WO-2009/059731 | A1 | 5/2009 |

OTHER PUBLICATIONS

International Preliminary on Patentabliity dated Jun. 14, 2012. PCT/EP2010/0051391.

* cited by examiner

THIN-WALLED, COLD FORMED LIGHTWEIGHT STRUCTURAL PROFILE ELEMENT AND METHOD FOR PRODUCING SUCH A PROFILE ELEMENT

CROSS-REFERENCE TO RELATED APPLICATIONS

This application is the U.S. National Phase of PCT/EP2010/005891 filed Sep. 27, 2010, which claims priority of German Patent Applications 10 2009 047 958.9 filed Oct. 1, 2009; 10 2009 048 152.4 filed Oct. 2, 2009; and 10 2010 026 320.6 filed Jul. 7, 2010.

The present invention relates to a thin-walled cold formed lightweight sectional element, in particular a dry construction section, a section for the face of a building, a plaster section, a base section, a screed section, a tile section or a cable carrier section or a frame rail or drainage rail, having an elongated section body which is in particular metal or comprises plastic and in which a plurality of openings are formed. The invention is furthermore directed to a method for manufacturing such a thin-walled cold formed sectional element.

Thin-walled cold formed sectional elements of this type are used, for example, as C-shaped upright sections for dry construction, wherein the openings provided in the section body of the sectional element can serve, for example, as leadthrough openings for cables, lines or other elongated band-shaped or rope-shaped elements as well as pipes or other hollow bodies. These openings can furthermore also serve for ventilation or to allow the passing through of filler materials such as insulating material.

In known thin-walled cold formed sectional elements, these openings are introduced by a punching procedure, for example. It is disadvantageous in this that the punched out material forms waste, whereby the manufacturing costs for such thin-walled cold formed sectional elements are increased.

It is an object of the present invention to provide a thin-walled cold formed sectional element of the initially named kind which can be manufactured in a simple and inexpensive manner and with reduced material effort. Furthermore, a method for manufacturing such a thin-walled cold formed sectional element will be provided.

Starting from a thin-walled cold formed sectional element of the initially named kind, the object relating to the sectional element is satisfied in that the section body includes at least two separately formed longitudinal portions, in that each longitudinal portion includes a meandering longitudinal edge, in that the longitudinal portions each include an elongated portion as well as a plurality of connection portions which project laterally beyond the elongated portion and which are bordered by the meandering longitudinal edge, in that the connection portions of the one longitudinal portion face the connection portions of the other longitudinal portion and are welded thereto end-to-end or are mutually connected along bent-over abutment edges, in that the openings are at least regionally bordered by portions of the meandering longitudinal edges, in that stiffening beads extending in the longitudinal direction of the longitudinal portions and stiffening beads extending transverse thereto are formed in the longitudinal portions, in that the transverse extending stiffening beads are in communication with the stiffening beads extending in the longitudinal direction, and in that the transverse extending stiffening beads extend into the connection portions.

The part of the object relating to the method is satisfied, starting from a method of the initially named kind, in that two separate longitudinal portions each having a meandering longitudinal edge are provided to produce the profile body, wherein the longitudinal portions each include a meandering longitudinal edge, wherein the longitudinal portions each include an elongated portion as well as a plurality of connection portions which project laterally beyond the elongated portion and which are bordered by the meandering longitudinal edge, in that the longitudinal portions are moved apart transverse to their longitudinal extent, in that the connection portions of the one longitudinal portion are welded end-to-end to the connection portions of the other longitudinal portion such that the openings are formed between portions of the meandering longitudinal edges, and in that stiffening beads extending in the longitudinal direction of the longitudinal portions and stiffening beads extending transverse thereto are formed in the longitudinal portions, wherein the transverse extending stiffening beads are in communication with the stiffening beads extending in the longitudinal direction, and the transverse extending stiffening beads extend into the connection portions.

In accordance with the invention, no waste is thus generated for the production of the openings of the section body so that material can be saved with respect to a production by punching out, for example. In other words, a wider design of the sectional element is achieved with the same quantity of material by the moving apart of two separately formed longitudinal portions. It is possible due to the connection portions respectively projecting laterally over the elongated portions of the two longitudinal portions to move apart the longitudinal portions transverse to their longitudinal portions so that a connection of the two longitudinal portions is possible despite this moving apart so that ultimately a larger width is achieved than the width of the original material portion. In this respect, the term "transverse" is to be understood as any direction which does not extend only in the longitudinal direction of the sectional element or its longitudinal portions. The term "transverse" can thus in particular mean perpendicular or also oblique to the longitudinal extent of the sectional element or of the longitudinal portions. The connection portions are furthermore welded to one another end to end or are connected to one another along bent-over abutment edges so that there are no larger overlapping regions, but rather substantially edge connections between the two longitudinal portions. An ideal material utilization is also thereby achieved. It is ensured in an ideal manner by the stiffening beads arranged and mutually connected in accordance with the invention that a stiffening takes place directly at the regions of the sectional element weakened by the openings so that the stiffness of the sectional element is of equal quality to known sectional elements or is even improved with respect to them. The torsional strength and the deflection strength of a sectional element made in accordance with the invention can in particular be increased by the stiffening beads.

The part of the object relating to the method is also satisfied in accordance with the invention, starting from a method of the initially named kind in that at least two separate longitudinal portions each having a meandering longitudinal edge are provided to produce the section body, wherein the longitudinal portions each include an elongated portion as well as a plurality of connection portions which project laterally beyond the elongated portion and which are bordered by the meandering longitudinal edge, in that the longitudinal portions are arranged so that they contact one another in a flat manner and respective connection edges of the connection portions of the one longitudinal portion extending in the longitudinal direction directly contact connection edges of the connection portions of the other longitudinal portion extending in the longitudinal direct, in that the connection portions of the one longitudinal portion are connected, in particular welded, to the connection portions of the other longitudinal portion, in that one of the two longitudinal portions is pivoted about the connection edges with respect to the other longitudinal section so that the connection portions are mutually connected along bent-over abutment edges and the openings are formed between portions of the meandering longitudinal edges, and in that stiffening beads extending in the longitudinal direction of the longitudinal portions as well as stiffening beads extending transverse thereto are formed in the longitudinal portions, wherein the transverse extending stiffening beads are in communication with the stiffening beads extending in the longitudinal direction, and the transverse extending stiffening beads extend into the connection portions.

In accordance with an advantageous embodiment of the invention, the connection portions of the two longitudinal portions each include connection edges or bent-over abutment edges which are adjacent to one another and extend substantially parallel to one another. The longitudinal portions can ultimately be connected to one another via these connection edges or bent-over abutment edges. The connection edges in this respect preferably extend substantially parallel, perpendicular or oblique, for example at a 45° angle, and the bent-over abutment edges parallel to the longitudinal extent.

In accordance with a further advantageous embodiment of the invention, the connection portions are T-shaped, web-shaped, trapezoidal shaped or triangular or include hexagonal regions. Preset properties of the sectional element, for example its stiffness, can be influenced by a corresponding design of the connection portions. Furthermore, dependent on the selected shape of the connection portions, a respective different kind of connection of the two longitudinal portions is made possible, as will be described in more detail in this application.

A respective connection portion of the one longitudinal portion is preferably disposed opposite a connection portion of the other longitudinal portion. Alternatively or additionally, connection portions can also be provided which are arranged alternatingly in the longitudinal direction of the sectional element. The arrangement of the connection portions in the final sectional element is in turn dependent on different connection kinds which will likewise be described in the further text.

The longitudinal portions advantageously have a thickness of approximately between 0.5 mm and 3 mm. The sectional elements in accordance with the invention are thus lightweight sections which can be used in different manners. For example, in addition to the initially named uses, applications are also conceivable in the automotive sector, in switch cabinet construction, in cover systems or even as vine supports or wine posts.

The weld connection between the connection portions is advantageously made as a discontinuous laser weld seam. A better strength in the center region of the sectional element, which is in particular weakened by the openings, is achieved by the design as a laser weld seam. The laser weld seam can be made with a reduced extent in the transverse direction with respect to a usual weld connection. Due to the reduced extent and the heat concentration which thereby arises in a very small space a very good hardness is achieved after the cooling in the zone of the sectional element melted during laser welding. Furthermore, the seam can be generated by the laser welding exactly at the center between the connection edges mutually connecting end-to-end so that the adjoining regions of the sectional element are not impaired by the welding process and furthermore a very smooth transition is achieved between the two longitudinal portions.

In accordance with a further advantageous embodiment, at least some of the stiffening beads extend beyond the weld seams between the connection portions. An additional reinforcement of the weld connections is thereby achieved.

A stiffening bead formed in a longitudinal portion and extending in a longitudinal direction is preferably connected to a stiffening bead formed in the other longitudinal portion and extending in the longitudinal direction via one or more of the transverse extending stiffening beads. The stiffening beads can thereby form a kind of ladder structure by which the openings are completely surrounded. The stiffness of the sectional element is thereby particularly increased in a strain-optimized manner in the regions weakened by the openings.

The stiffening beads extending in the longitudinal direction advantageously extend over the total length of the respective longitudinal portion. The improved stiffness can thereby be achieved uniformly over the whole length of the sectional element. It is generally also possible that the stiffening beads extending in the longitudinal direction are interrupted once or a multiple of times as long as the desired stiffness is maintained in so doing.

The material of the section body bordering the openings can in particular be deep drawn. An increased stiffness of the sectional element is thereby in turn achieved particularly in the weakened region of the openings. The edges of the section body bordering the openings can advantageously be bent over, in particular made as flanged edges.

It is also possible that, in another embodiment, the connection portions of the one longitudinal portion are connected to the connection portions of the other longitudinal portion via an intermediate element arranged between the longitudinal portions so that there is an indirect connection between the connection portions. The connection between the connection elements and the intermediate element can in this respect take place end-to-end or overlapping. The intermediate element can in this respect preferably be made as an elongated strip-shaped element. The intermediate element can in this respect in particular have a thickness which is of the same magnitude as the thickness of the longitudinal portions.

In accordance with a further advantageous embodiment of the invention, the intermediate element has longitudinal edges extending substantially parallel to the longitudinal extent of the longitudinal portions. A simple connection of the connection edges of the connection elements to the longitudinal edges of the intermediate element is thereby possible.

The connection portions are preferably connected to the intermediate element by a pressure joining process such as by clinching or crimping, by clamping, squeezing, pressing, welding, screwing, adhesive bonding, riveting or folding or by a plug-in connection. The weld connection can in particular also again advantageously be made here as a laser weld connection with the named advantages.

The intermediate element can also advantageously have a thickness of approximately 0.5 mm and 3 mm.

In accordance with a further advantageous embodiment of the invention, the intermediate element can be made of a different material than the longitudinal portions. The intermediate element can in particular be made of plastic, in particular of PVC, and the longitudinal portions of metal, in particular of aluminum. The weight of the total section can be further reduced by the use of plastic, on the one hand, and a good thermal insulation is possible, on the other hand. Furthermore, costs can be reduced by the use of plastic.

The separate longitudinal portions can already be originally manufactured from separate material portions. They can, for example, have the same or different material thicknesses and can also comprise the same or different materials.

The separate longitudinal portions can advantageously be manufactured from an originally uniform material portion. In this case, at least one meandering slit which extends in the longitudinal extent of the starting material and by which the starting material is divided into two separate longitudinal portions can be introduced into an elongated strip-shaped starting material. It is also possible that at least two strip-shaped material portions are placed onto one another in a flat manner and that, in a cutting process, a meandering slit passing through both material portions is introduced so that at least four longitudinal portions are produced in one cutting process. A respective two of these can, for example, be connected to form a profile body.

The longitudinal portions are advantageously moved apart substantially perpendicular to their longitudinal extent. A moving apart is, however, generally also conceivable oblique to the longitudinal extent of the longitudinal sections.

Whereas generally, in particular in dependence on the shape of the connection portions, the connecting of the longitudinal portions can take place directly after the moving apart of the longitudinal portions transverse to their longitudinal extent, in accordance with a further embodiment of the invention the longitudinal portions can be substantially mutually displaced in the longitudinal direction in addition to the moving apart of the longitudinal portions transverse to their longitudinal extent. This longitudinal displacement of the longitudinal portions can in this respect take place before, after or simultaneously with the moving apart of the longitudinal portions transverse to their longitudinal extent. Such a longitudinal displacement can be necessary, for example, to bring the connection edges of two oppositely disposed connection portions into contact in order thus to enable a connection of the connection portions of the two oppositely disposed longitudinal portions.

Generally, the connection portions of the one longitudinal portion can be directly connected to the connection portions of the other longitudinal portion, in particular end-to-end or overlapping. In accordance with a further embodiment, it is, however, also possible that the longitudinal portions are moved apart until a spacing arises between the longitudinal portions, that an in particular elongated strip-shaped intermediate element is positioned between the spaced apart longitudinal portions, and that the connection portions of the two longitudinal portions are connected to the intermediate element, in particular end-to-end or overlapping. Even larger widths of the sectional element can be achieved in this manner.

Figure 2:
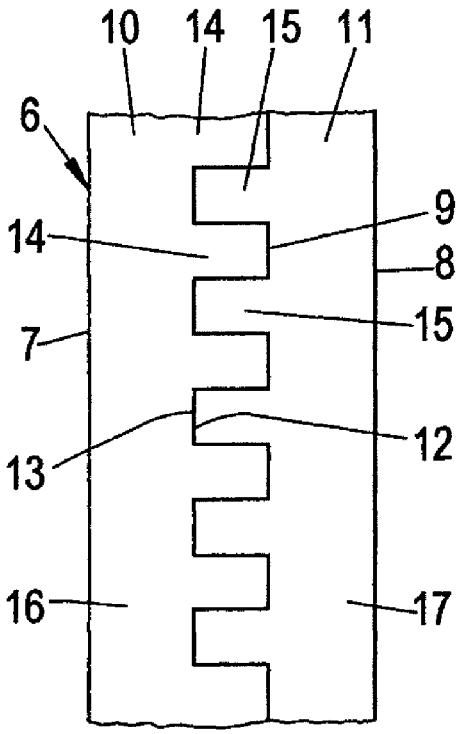
Figure 3:
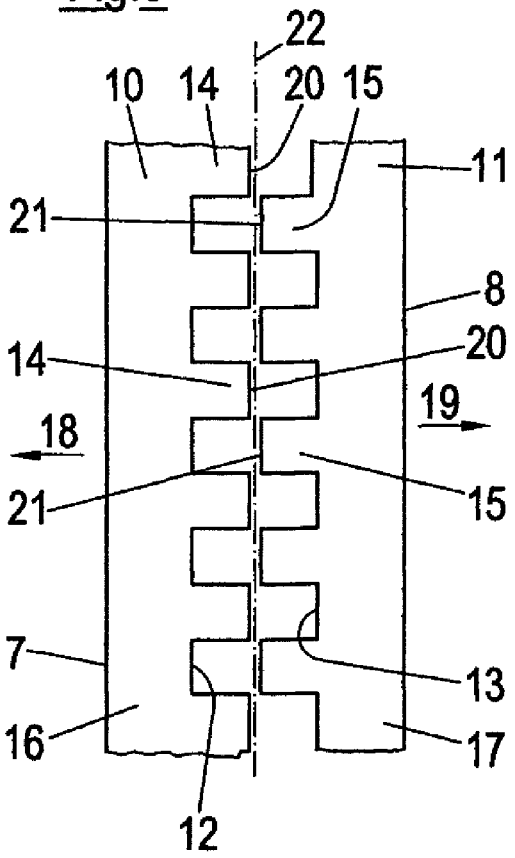
Figure 4:
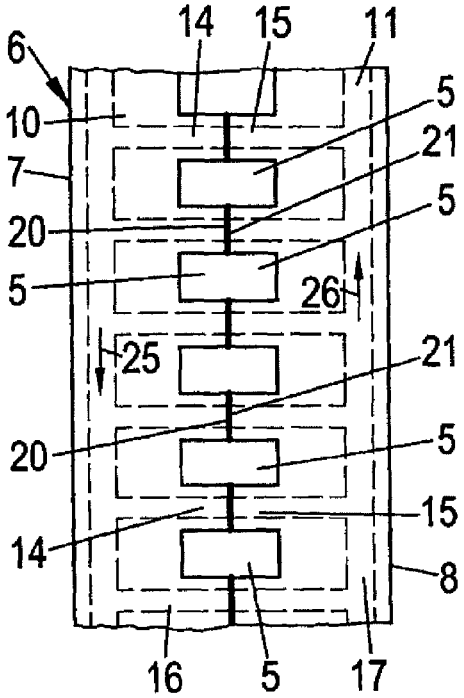
Figure 5:
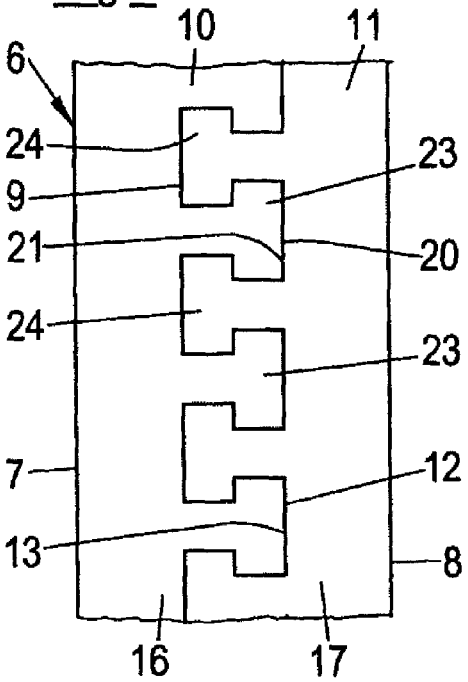
Figure 6:
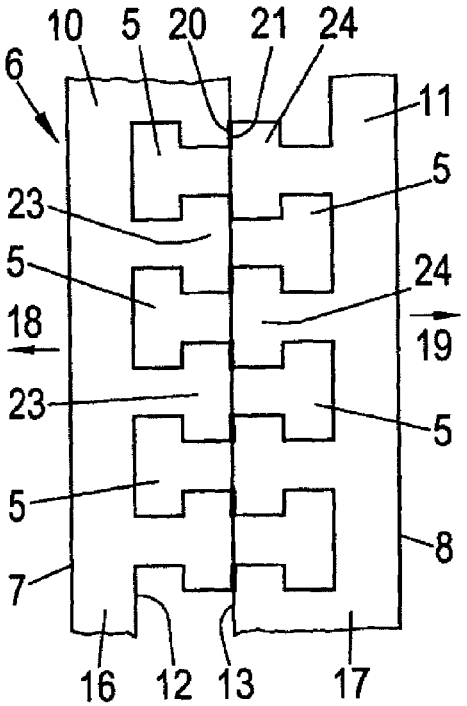
Figure 7:
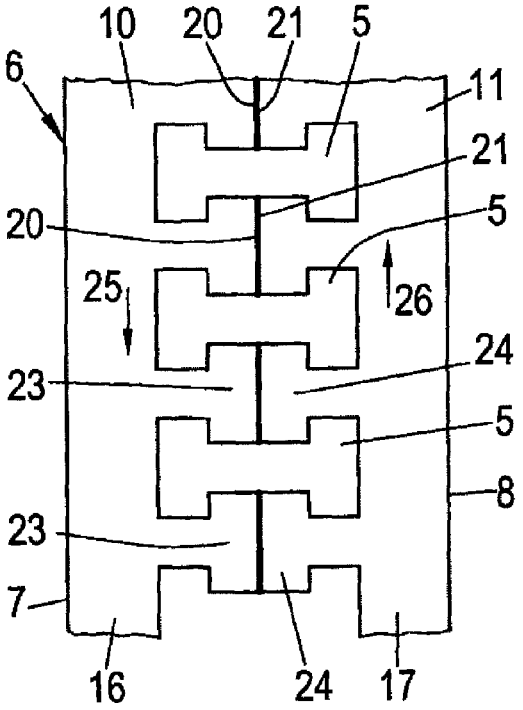
Figure 8:
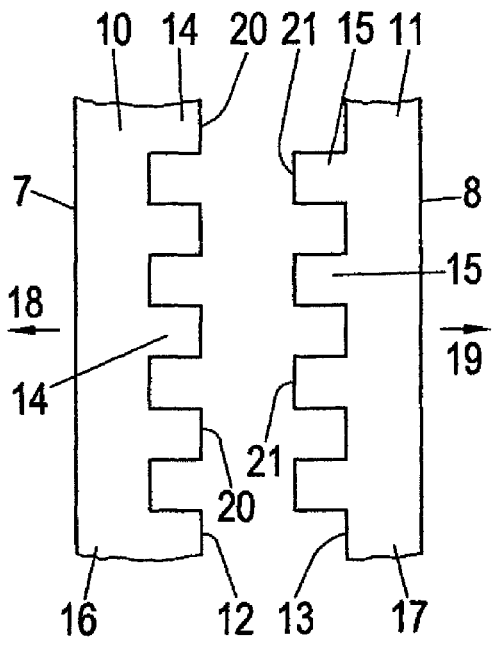
Figure 9:
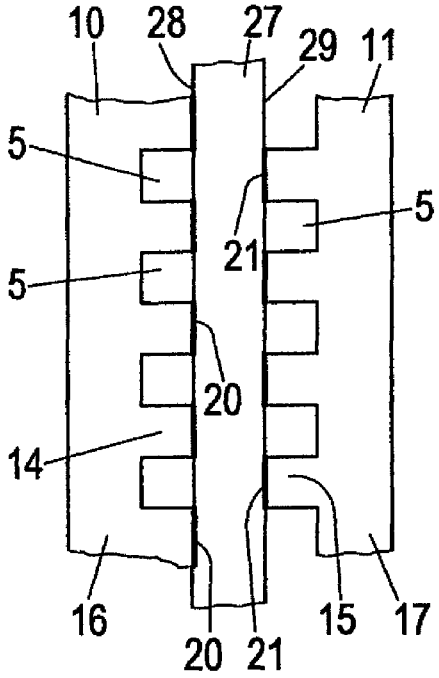
Figure 10:
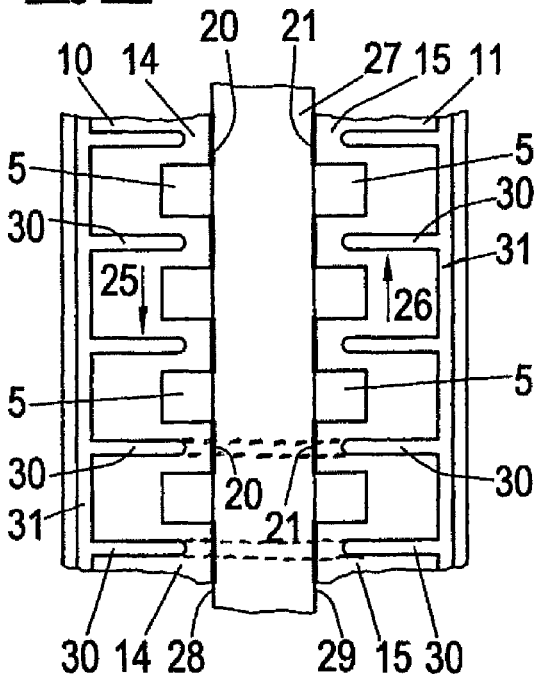
Figure 11:
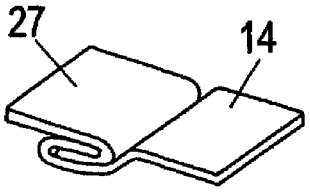
Figure 12:
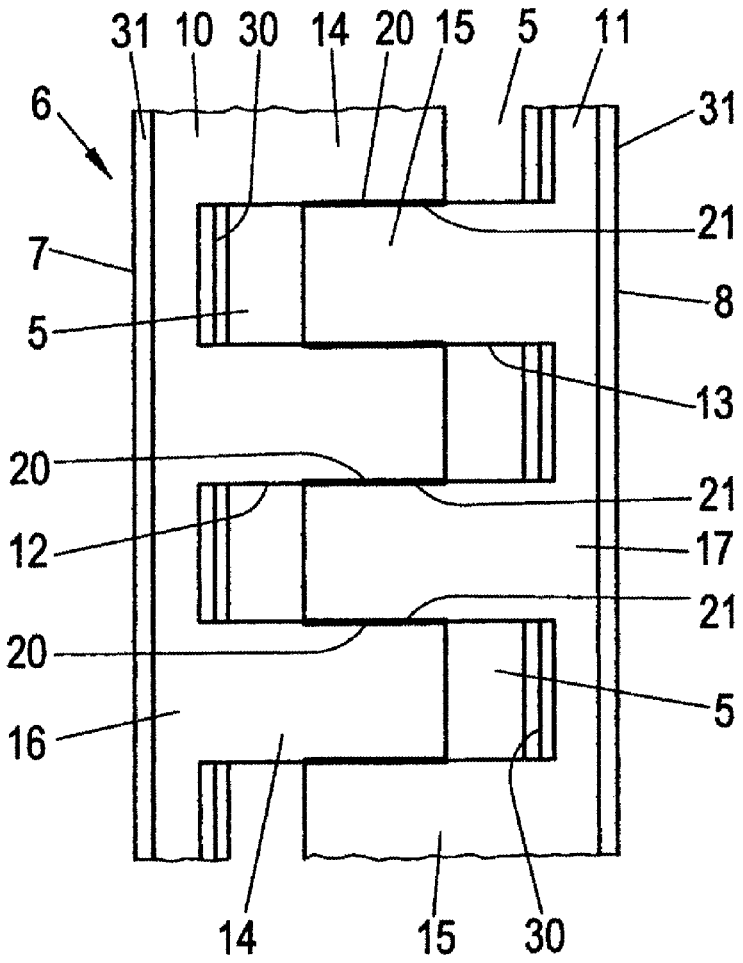
Figure 13:
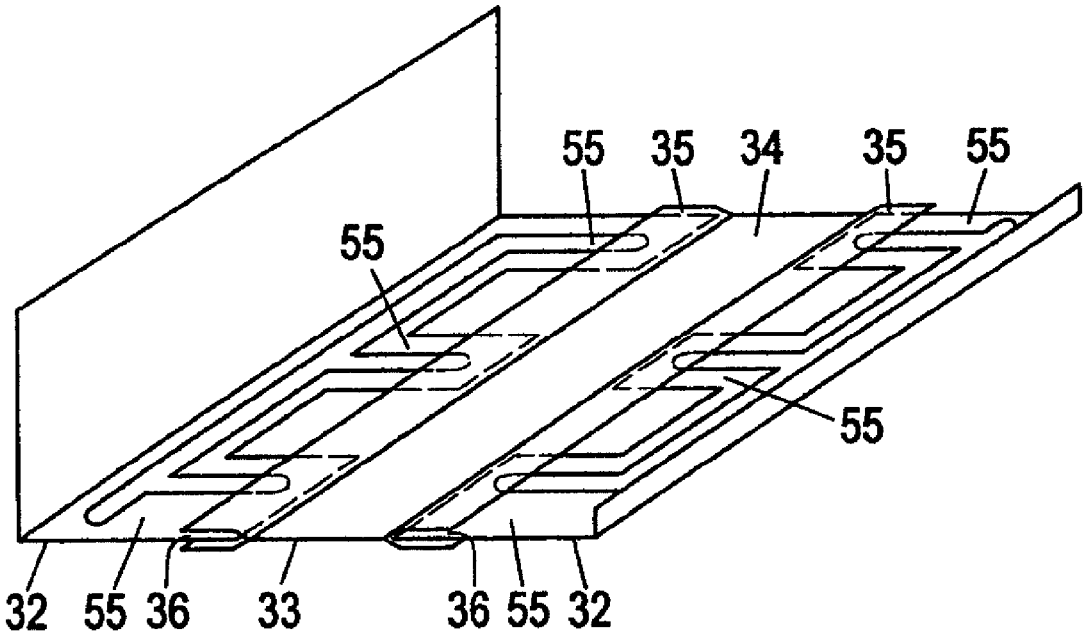
Figure 14:
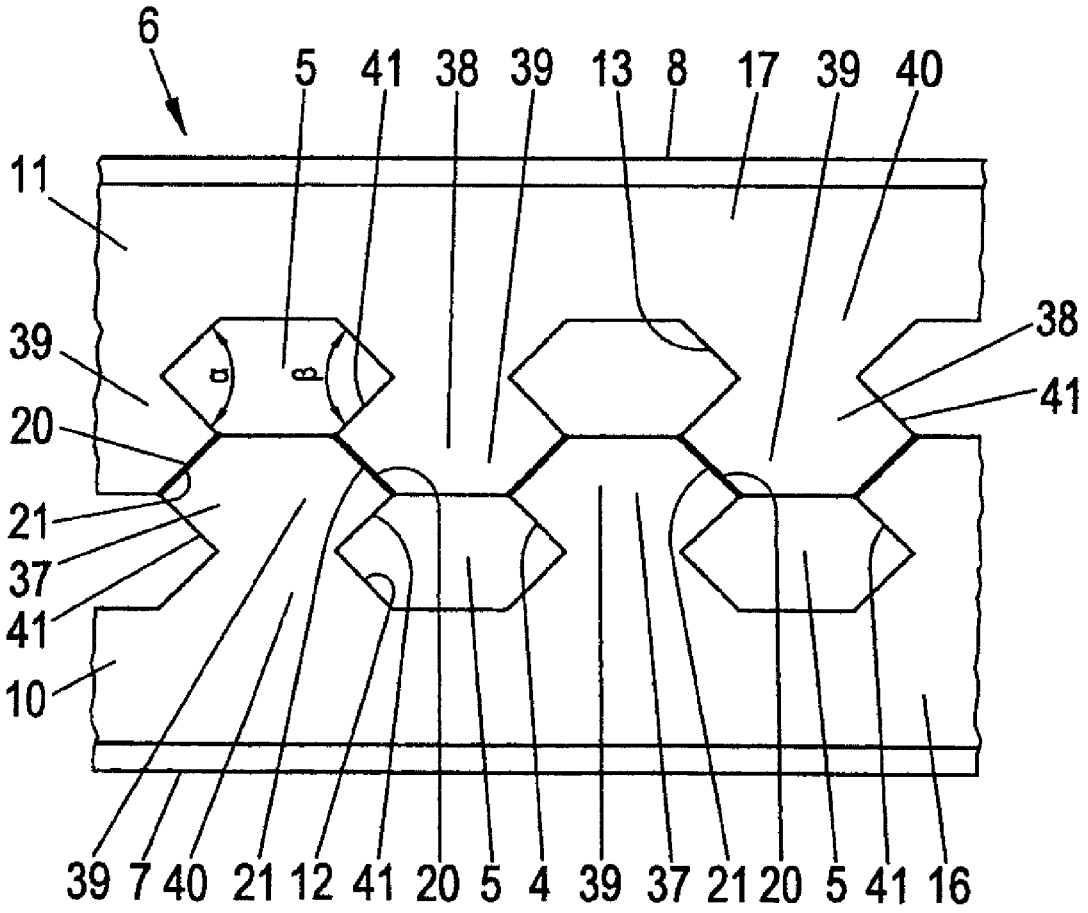
Figure 15:
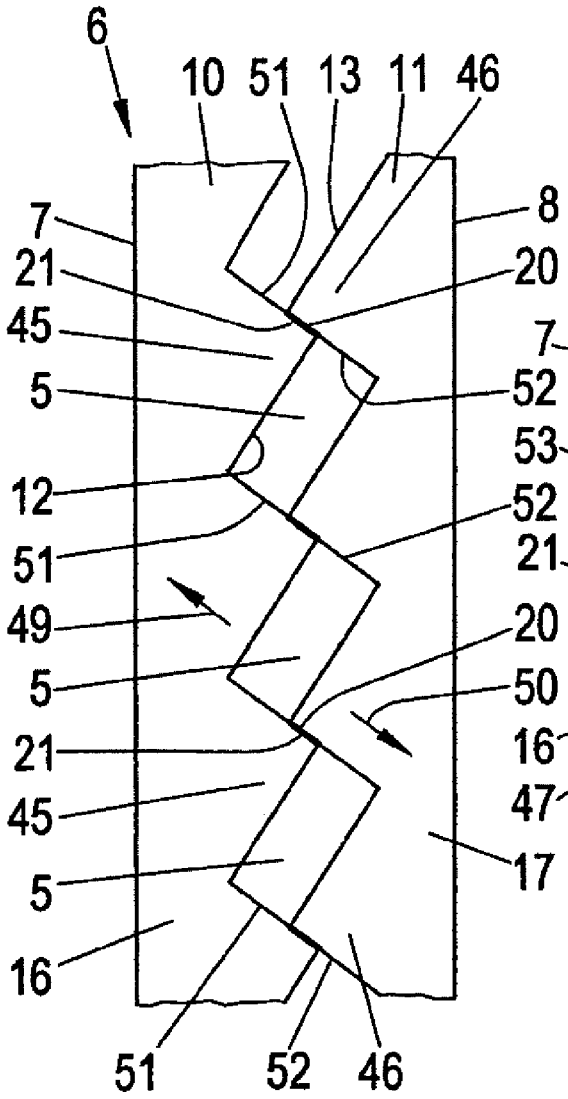
Figure 16:
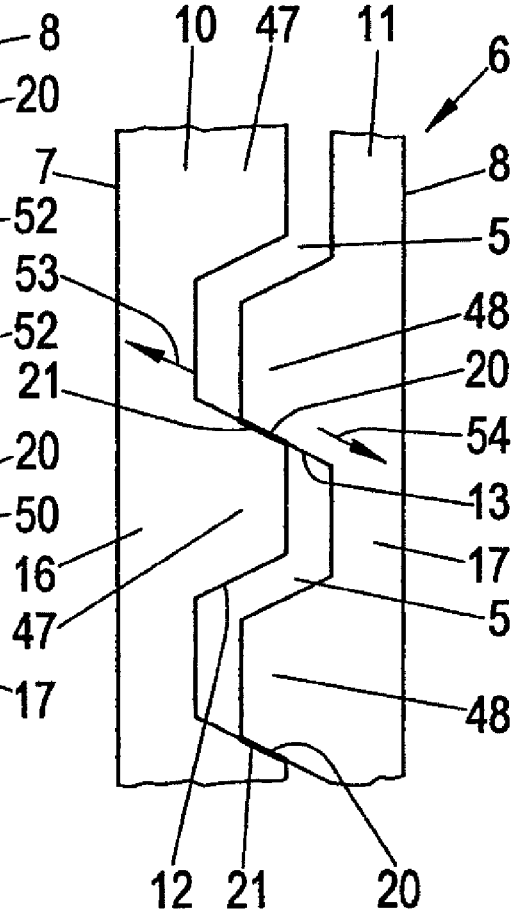
Figure 17:
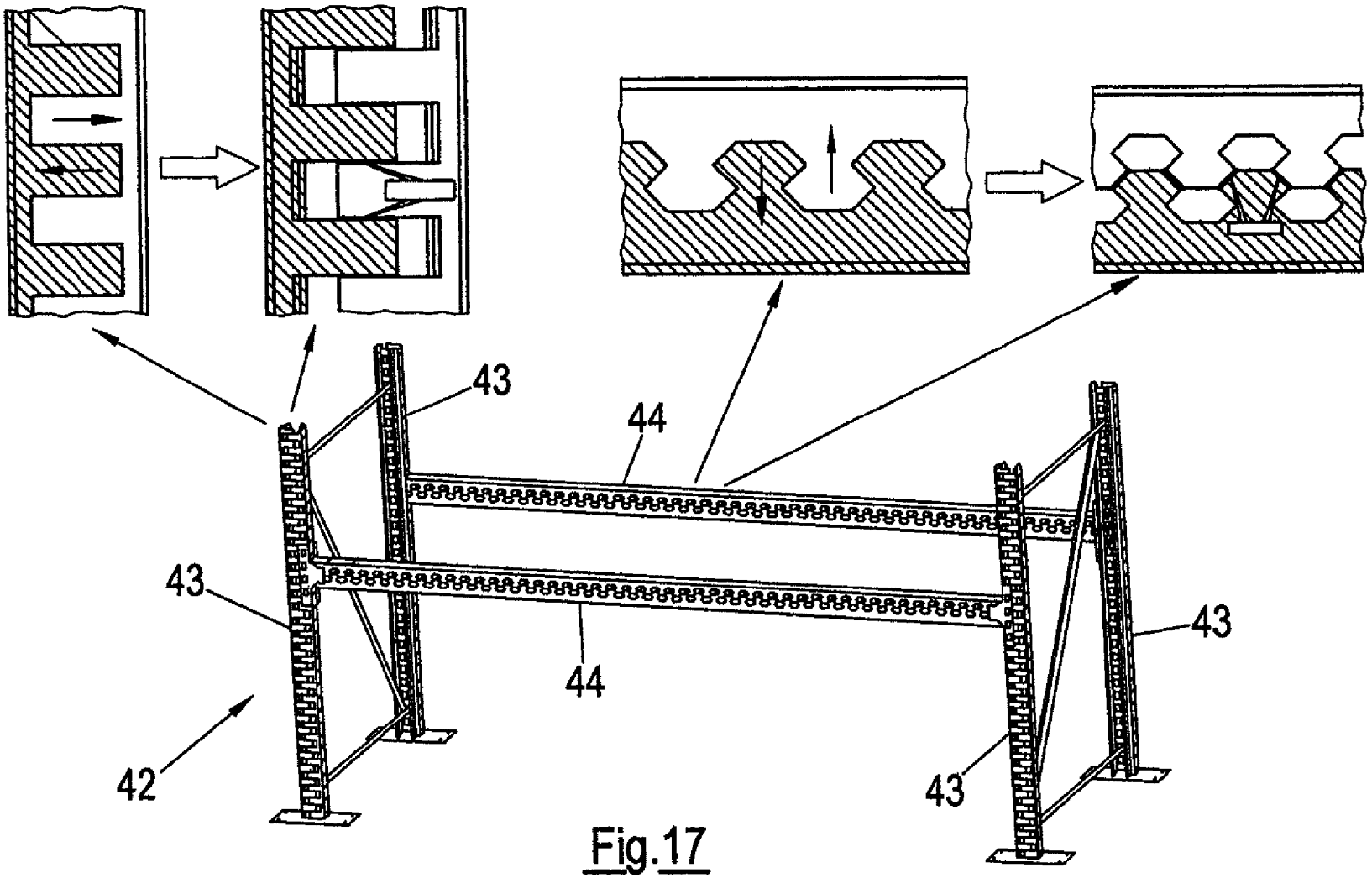
Figure 18:
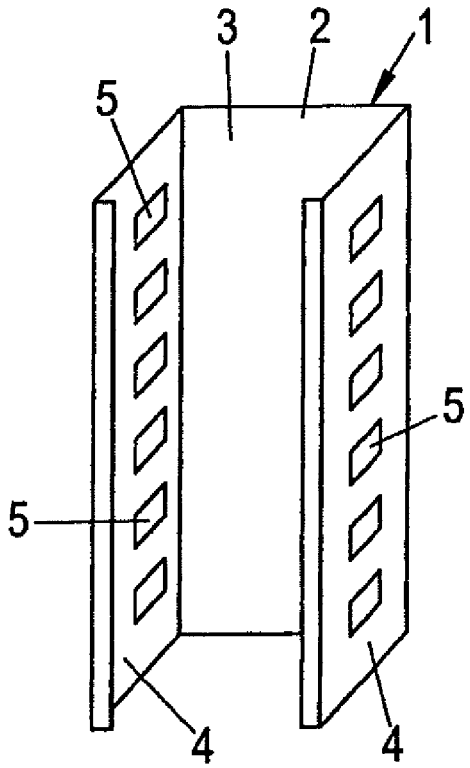
Figure 19:
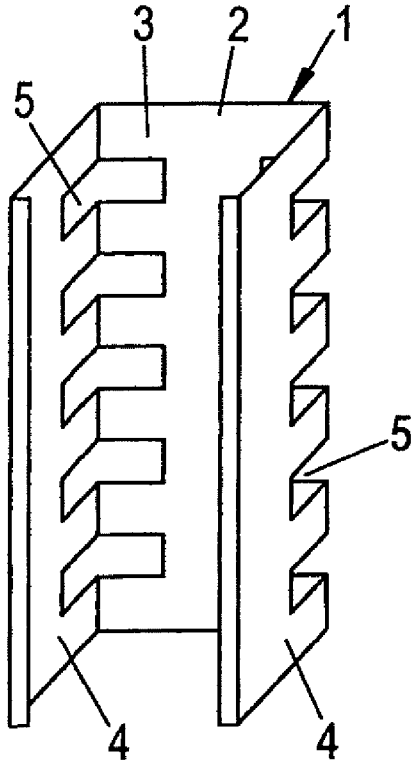
Figure 20:
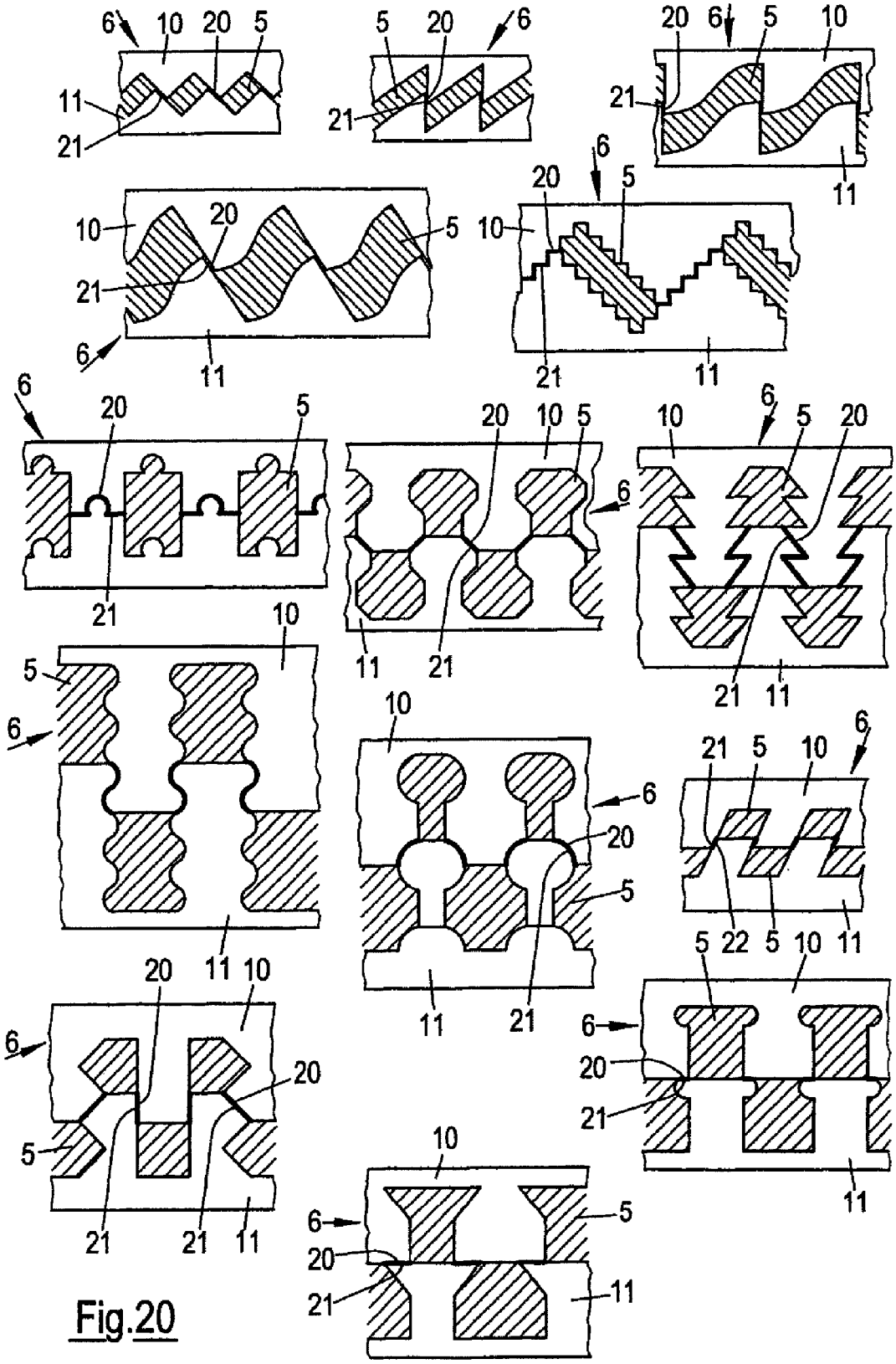
Figure 21:
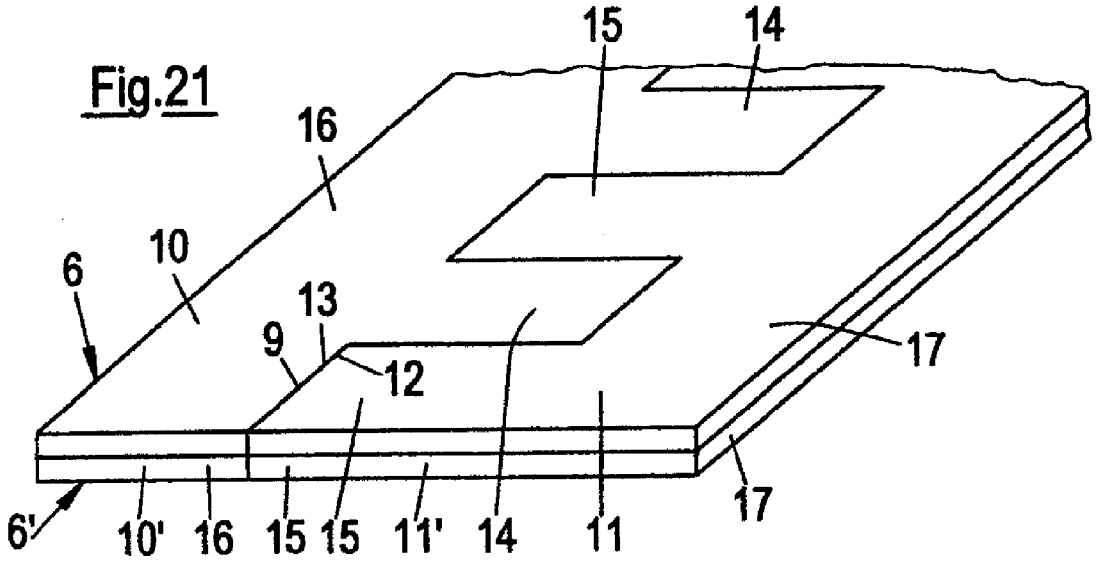
Figure 22:
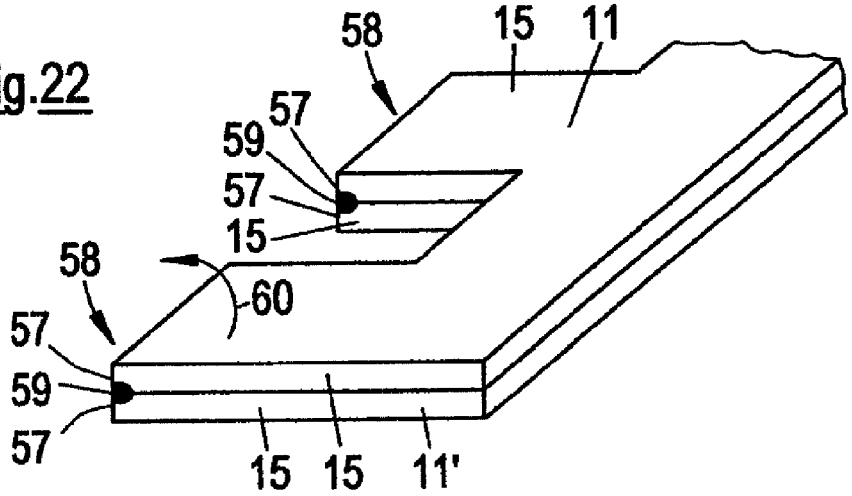
Figure 23:
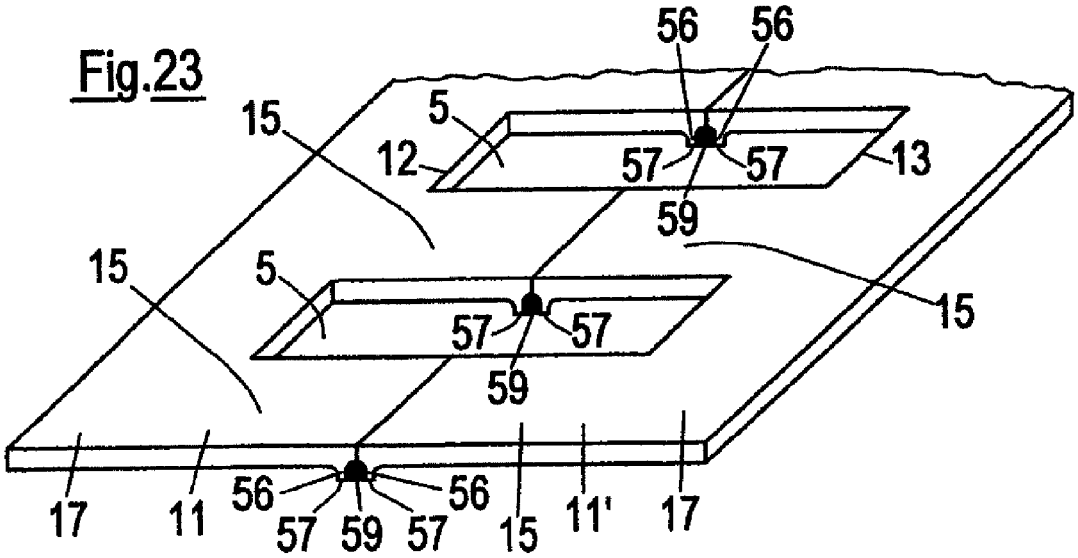

The invention will be described in more detail in the following with reference to embodiments and to the drawings; there are shown in these:

FIG. 1 a schematic perspective representation of a sectional element made in accordance with the invention;

FIGS. 2 to 4 a cutting pattern and different intermediate steps for the manufacture of a sectional element made in accordance with the invention in accordance with FIG. 1;

FIG. 5 a material portion with a cutting pattern to generate a further embodiment of the invention;

FIGS. 6 and 7 two different embodiments based on the cutting pattern of FIG. 5;

FIGS. 8 and 9 two intermediate conditions to produce a sectional element based on the cutting pattern shown in FIG. 2;

FIG. 10 a further embodiment of the invention;

FIG. 11 a part view of the invention;

FIG. 12 a further embodiment of the invention;

FIG. 13 a further embodiment of the invention;

FIG. 14 a further embodiment of the invention;

FIG. 15 a further embodiment of the invention;

FIG. 16 a further embodiment of the invention;

FIG. 17 the embodiments of FIGS. 12 and 14 in a frame construction;

FIG. 18 a further embodiment of the invention;

FIG. 19 a further embodiment of the invention;

FIG. 20 further possible embodiments of the invention;

FIG. 21 a perspective representation of two material portions lying above one another to manufacture a sectional element in accordance with a further method in accordance with the invention;

FIG. 22 an intermediate step in the manufacture of the sectional element; and FIG. 23 the sectional element after the folding open of the two longitudinal sections.

FIG. 1 shows a sectional element 1 which is made as a C section. The sectional element 1 includes a section body 2 which has a section web 3 as well as two section limbs 4 laterally adjoining thereat which are each angled at a right angle to the section web 3. The free longitudinal edges of the section limbs 4 are in turn each angled by 90° to form the C section. The sectional element 1 in accordance with the invention can generally also be made, for example, as a U section, an L section, a T section, an H section, a hat section or a Z section.

A plurality of openings 5 are formed in the section web 3 which can serve, for example, as passage openings for cables or other elements to be laid. The openings 5 of the sectional element 1 are manufactured without material loss in accordance with the invention, as will be explained in more detail in the following with reference to FIGS. 2 to 4.

FIG. 2 shows a material strip 6, for example a sheet metal strip, which serves as a starting material for the section body 2. Whereas in FIGS. 2 to 4, only one relatively narrow region of the material strip 6 is shown in each case which is ultimately used to form the section web 3, further material regions can in each case adjoin its outer edges 7, 8, with the section limbs 4, for example, being formed by said further material regions by corresponding bending over.

A meandering slit 9 which extends in the longitudinal extent of the material strip 6 and by which the material strip 6 and thus the section body 2 is divided into two separate longitudinal portions 10, 11 is formed in the material strip 6. The longitudinal portions 10, 11 are each given meandering longitudinal edges 12, 13 by the meandering slit 9 which contact one another seamlessly in the representation in accordance with FIG. 2. The meandering longitudinal edges 12, 13 each include edge portions extending in the longitudinal direction and extending perpendicular thereto respectively.

Web-shaped connection portions 14, 15 of the longitudinal portions 10, 11 are respectively formed by the meandering longitudinal edges 12, 13 and are each connected in one piece to elongated portions 16, 17 of the longitudinal portions 10, 11 and project laterally beyond them. As can furthermore be recognized from FIG. 2, the web-shaped connection portions 14 are bordered by the meandering longitudinal edge 12 and the web-shaped connection portions 15 are bordered by the meandering longitudinal edge 13.

To produce the final shape of the section web 3, the two longitudinal portions 10, 11 are moved apart in accordance with two arrows 18, 19 transverse to the longitudinal extent of the material strip 6 until they adopt the position shown in FIG.

3. In this position, connection edges 20, 21 of the connection portions 14, 15 extending in the longitudinal direction of the longitudinal portions 10, 11 lie on a straight line 22 which is shown by dashed lines and which likewise extends in the longitudinal direction of the longitudinal portions 10, 11.

In accordance with FIG. 4, in a next step, the two longitudinal portions 10, 11 are displaced with respect to one another in accordance with arrows 25, 26 in the longitudinal direction of the longitudinal portions 10, 11 until a respective connection portion 14 lies opposite a connection portion 15. In this position, a respective connection edge 20 accordingly contacts a connection edge 21, as is shown in FIG. 4.

Subsequently, the longitudinal portions 10, 11 are welded to one another, for example laser welded, along the mutually contacting connection edges 20, 21, whereby the final shape of the section web 3 with the openings 5 is achieved.

For better clarity, the same reference numerals as in FIGS. 1 to 4 will be used in the following for the same or similar elements in the description of the further embodiments.

The embodiment in accordance with FIG. 5 only differs from the previously described embodiment in that T-shaped connection portions 23, 24 are formed by the meandering slit 9.

To produce the final shape of the section web 3, in this embodiment, the two longitudinal portions 10, 11 are in turn pulled apart in accordance with arrows 18, 19 transverse to their longitudinal extent, as is shown in FIG. 6. In this condition, the connection edges 20, 21 of the T-shaped connection portions 23, 24 in turn lie on a line and can be welded, for example laser welded, to form the section web 3 and the openings 5 along the connection edges 20, 21. In contrast to the first embodiment, in this embodiment the openings 5 are not arranged behind one another in the longitudinal direction, but alternating, as can be recognized from FIG. 6. Due to the T-shaped formation of the connection portions 23, 24, the connection edges 20, 21 already contact one another at least partly after the pulling apart transverse to the longitudinal direction of the longitudinal portions 10, 11 so that the described connection can already be established in this condition.

It is, however, also possible that, in a further method step, the longitudinal portions 10, 11 are additionally displaced in the longitudinal direction in accordance with arrows 25, 26 until they reach the positions shown in FIG. 7. In this position, the connection edges 20, 21 fully contact one another and can be welded to one another, for example laser welded, to produce the section web 3. In this variant, the openings 5 are in turn arranged disposed behind one another in the longitudinal direction and have an H-shaped design formed by the meandering longitudinal edges 12, 13. Generally, it is also possible that the two longitudinal portions 10, 11 are first displaced with respect to one another in the longitudinal direction and subsequently transverse to the longitudinal direction until the position shown in FIG. 7 is reached. An oblique displacement is generally also possible.

In a further embodiment, the longitudinal portions 10, 11 from FIGS. 2 and 3 can be pulled apart even further in accordance with the arrows 18, 19 until they reach the positions shown in FIG. 8 in which they are arranged spaced apart from one another. In this condition, an additional intermediate element 27 in the form of an elongated strip-shaped element can be inserted between the two longitudinal portions 10, 11, as is shown in FIG. 9. The intermediate element 27 has longitudinal edges 28, 29 which extend parallel to the longitudinal extent of the longitudinal portions 10, 11 and which contact the connection edges 20, 21 of the connection portions 14, 15, as can be recognized from FIG. 9. To produce the final shape of the section webs 3, the connection edges 20, 21 are subsequently connected, for example welded, to the longitudinal edges 28, 29 of the intermediate element 27. At the same time, the openings 5 are thereby formed which are in turn arranged alternating in the longitudinal direction of the section web 3.

In a similar manner as already described with respect to FIG. 7, the longitudinal portions 10, 11 in this embodiment can in turn also additionally be displaced in the longitudinal direction with respect to one another in accordance with the arrows 25, 26 until they reach the positions shown in FIG. 10. In this position, the respective connection portions 14, 15 of the longitudinal portions 10, 11 are disposed opposite one another, whereas they are arranged alternating in the longitudinal direction of the section web in the embodiment of FIG. 9.

The connection edges 20, 21 of the connection portions 14, 15 are subsequently connected, for example welded, to the longitudinal edges 28, 29 of the intermediate element 27 so that the final shape of the sectional element 3 and the openings 5 are formed.

Whereas in FIGS. 8 to 10 the connection of the longitudinal portions 10, 11 via the intermediate element 27 was described in each case with reference to longitudinal portions 10, 11 having web-shaped connection portions 14, 15, the connection portions can also have any otherwise suitable shape, for example the T-shaped design of the connection portions 23, 24 from FIGS. 5 to 7. Furthermore, in all embodiments, the connection between the connection portions 14, 15 and 23, 24 with the intermediate element 27 was described as a connection of their edges 20, 21 and 28, 29 respectively. It is, however, generally also possible that the connection portions overlap with the intermediate element and corresponding areal connections are produced between these elements, for example by pressure joining processes such as by clinching or crimping, by clamping, squeezing, pressing, welding, screwing, adhesive bonding, riveting or folding or by a plug-in connection.

A corresponding areal fold connection between the web 27 and the connection portion 14 is shown broken away in a detailed view by way of example in FIG. 11.

Stiffening beads 30 such as are only shown in FIG. 10 are formed in the material portion 6 in accordance with the invention. These stiffening beads 30 are made in or extend into the connection portions. An advantageous stiffening is achieved by a profile transverse to the longitudinal direction of the section web 3. Corresponding stiffening beads 31 which extend in the longitudinal direction of the material portion 6 and which are in communication with the stiffening beads 30, as is shown in FIG. 10, are also formed in the region of the longitudinal edges 7, 8. The stiffening beads 30 can in this respect extend from a stiffening bead 31 extending in the longitudinal direction to the oppositely disposed stiffening bead 31 so that they are connected to one another and the openings 5 are completely surrounded by stiffening beads, as is indicated in FIG. 4 and in the lower region of FIG. 10 by dashed lines. The stiffening beads 31 in this respect extend beyond the weld seams in order additionally to reinforce them. Corresponding stiffening beads are provided in all embodiments even if they are not explicitly shown.

The intermediate element 27 can be made without interruption or with openings, not shown. These openings can be achieved, for example, by punched portions. The intermediate element 27 can advantageously also be provided with openings and widened by a corresponding stretching process. Furthermore, stiffening elements, for example in the form of embossed portions or stiffening beads, can likewise be formed in the intermediate element 27.

The embodiment in accordance with FIG. 12 differs from the embodiment in accordance with FIGS. 2 to 4 in that the two longitudinal portions 10, 11 are only pulled apart so far transverse to the longitudinal extent of the material strip 6 that the connection portions 14, 15 still engage into one another in the manner of a comb, as is shown in FIG. 12. In this position, the edges of the connection portions 14, 15 contacting one another end-to-end form the connection edges 20, 21 which are butt welded to one another.

FIG. 13 shows a sectional element made as a base section in which two outwardly disposed longitudinal portions 32 are plugged together with a strip-shaped intermediate element 33 arranged therebetween. The intermediate element 33 has a single-layer center region 34 which is adjoined by two double-layer outer regions 35. They are made U-shaped in cross-section and form recipients 36 for the connection portions 55 of the longitudinal portions 32 into which they can be plugged and held in a clamping manner. The longitudinal portions 32 can in this respect be made of metal, in particular of aluminum, whereas the intermediate element 33 can preferably be made of plastic and in particular as an injection molded part or as a continually extruded section.

In the embodiment in accordance with FIG. 14, the connection portions are made as hexagonal connection portions 37, 38. The hexagonal connection portions 37, 38 each include a hexagonal region 39 as well as a trapezoidal region 40 which adjoins thereat and which is respectively connected to the elongated portion 16 and 17 respectively. The connection edges 20, 21 are made as obliquely extending edges of the hexagonal regions 39 and in particular extend at a 45° angle to the longitudinal extent of the material strip 6. The connection edges 20, 21 and edges 41 of the hexagonal regions 39 adjoining thereat each include an angle of 90° so that corresponding angles $\alpha$, $\beta$ of the openings 5 are also formed as 90° angles.

The connection edges 20, 21 contact one another end-to-end and are, analog to the embodiment in accordance with FIG. 12, butt welded, in particular laser welded, to one another.

In the embodiment in accordance with FIG. 15, the connection portions are made as triangular connection portions 45, 46. To form the triangular connection portions 45, 46, a sawtooth-like slit is introduced into the material strip 6 by which the meandering longitudinal edges 12, 13 are formed. Subsequently, the two longitudinal portions 10, 11 are pulled apart obliquely to the longitudinal extent of the material strip 6 in accordance with two arrows 49, 50. The movement direction of the two longitudinal portions 10, 11 in this respect substantially extends parallel to two flanks 51, 52 of the meandering longitudinal edges 12, 13. In this respect, the two longitudinal portions 10, 11 are only pulled apart so far that the flanks 51, 52 still contact one another region-wise, whereby the connection edges 20, 21 are formed. They can in turn be butt welded to one another, as described with respect to FIGS. 12 and 13.

The embodiment shown in FIG. 16 in turn includes trapezoidal connection portions 47, 48 which are each connected at their long base sides to the elongated portions 16, 17. The two longitudinal portions 10, 11 are, in a similar manner as described with respect to FIG. 15, pulled apart in accordance with two arrows 53, 54 oblique to the longitudinal extent of the material strip 6 and substantially parallel to the limbs of the trapezoidal portions 47, 48 to reach the position shown in FIG. 16. In this position, the limbs of the trapezoidal portions 47, 48 are still region-wise in contact, whereby the connection edges 20, 21 are formed. They can in turn be butt welded to one another, as described with respect to FIGS. 12 and 13.

FIG. 17 shows the structure of a frame 42 in which the vertical rails 43 are formed by sections which are made in accordance with the embodiment in accordance with FIG. 12. The horizontal rails 44 are, in contrast, formed by way of example in accordance with the embodiment in accordance with FIG. 14. This is shown schematically in the upper region of FIG. 17 in each case. Both the horizontal and the vertical rails 43, 44 can naturally also be formed in accordance with a different embodiment described in the application.

It is schematically shown in FIG. 18 that the openings 5 cannot only be formed in the section web 3, but alternatively or additionally also in one or in both section limbs 4. It is furthermore schematically shown in FIG. 19 that the openings 5 can also extend from the profile web 3 over the outer edges 7, 8 into the section limbs 4. In addition, openings 5 can also be provided which are arranged completely in the section web 3 and/or in one or both section limbs 4. These different arrangements of the openings 5 can be provided in all embodiments of the invention.

FIG. 20 shows a plurality of further possible embodiments of the invention. In each case, material strips 6 are shown into which meandering slots of the most varied designs have been introduced, with subsequently the two longitudinal portions of the material strip 6 being pulled apart transverse to the longitudinal extent of the material strip 6 and additionally being displaced with respect to one another in the longitudinal extent in some cases. The openings 5 arising thereby are each shown as hatched. In all embodiments, connection edges 20, 21 which are shown in bold in each case for illustration are formed by portions of the meandering longitudinal edges. The two longitudinal portions 10, 11 are each butt welded to one another via the connection edges 20, 21, as has already been explained with respect to the previously described embodiments. The openings 5 can, for example, have diamond-shaped forms, flag-shaped forms, octagonal forms or the otherwise shown geometrical forms. As shown, depending on the shape, the two longitudinal portions 10, 11 can form undercuts transverse to their longitudinal extent in the direction of the moving apart which additionally reinforce the connection between the longitudinal portions 10, 11.

In FIG. 21, two substantially equally thick, flat material strips 6, 6' are arranged so that they lie flat over one another. A uniform meandering slit 9 was introduced into both material strips 6, 6' by which the material strips 6, 6' are divided into two longitudinal portions 10, 11 and 10', 11' respectively. In contrast to the previously described embodiments, in this embodiment the sectional element 1 is not formed by the originally contiguous longitudinal portions 10, 11 or 10', 11' respectively, but two sectional elements are rather formed of which one comprises the longitudinal portions 10, 10' and the other the longitudinal portions 11, 11'.

For this purpose, after producing the meandering slit 9, the longitudinal portions 10, 10' lying over one another are separated from the respective other longitudinal portions 11, 11' in order together to form sectional elements independent of one another.

In FIGS. 22 and 23, the manufacture of the sectional element 1 with the longitudinal portions 11, 11' is shown by way of example. The longitudinal portions 11, 11' lying over one another are welded together at connection edges 57 extending in the longitudinal direction so that weld seams 59 are produced which extend along the end faces 58 of the connection edges 57. Subsequently, the longitudinal portions 11, 11' are folded apart, as is indicated by an arrow 60 in FIG. 22. For this purpose, the longitudinal portion 11 is, for example, pivoted by approximately 180° about the connection edges 57 in accordance with the arrow 60 until it adopts the position shown in FIG. 23. In this position, the longitudinal portions 11, 11' lie substantially in a common plane.

The mutually connected connection edges 57 are bent over by the pivoting so that they form bent-over abutment edges 56 via which the longitudinal portions 11, 11' are connected to one another end-to-end. At the same time, the openings 5 are formed by the pivoting between portions of the meandering longitudinal edges 12, 13, without this being associated with material loss.

The connection between the bent-over abutment edges 56 can generally also be produced by other kinds of connection such as overlap welding, folding, adhesive bonding, clinching, riveting or clamping. In addition, the pivoting of the longitudinal portions can also take place about an angle different from 180°, in particular about a smaller or also larger angle, depending on which shape the final sectional element should have. The manufacture of the sectional element by folding open was admittedly only explicitly described in connection with the web-shaped connection portions 14, 15, but this manufacture is also possible with the other connection portions described within the framework of this application as long as the connection edges to be connected extend in the longitudinal direction of the material strip.

REFERENCE NUMERAL LIST

1 sectional element
2 section body
3 section web
4 section limb
5 openings
6, 6' material strip
7 outer edge
8 outer edge
9 meandering slit
10, 10' longitudinal portion
11, 11' longitudinal portion
12 meandering longitudinal edge
13 meandering longitudinal edge
14 web-shaped connection portions
15 web-shaped connection portions
16 elongated portions
17 elongated portions
18 arrow
19 arrow
20 connection edges
21 connection edges
22 line
23 T-shaped connection portions
24 T-shaped connection portions
25 arrow
26 arrow
27 intermediate element
28 longitudinal edge
29 longitudinal edge
30 stiffening beads
31 stiffening beads
32 longitudinal portions
33 intermediate element
34 center region
35 outer regions
36 lines
37 hexagonal connection portions
38 hexagonal connection portions
39 hexagonal regions
40 trapezoidal regions
41 edges
42 frame
43 vertical rails
44 horizontal rails
45 triangular connection portions
46 triangular connection portions
47 trapezoidal connection portions
48 trapezoidal connection portions
49 arrow
50 arrow
51 flank
52 flank
53 arrow
54 arrow
55 connection portions
56 bent-over abutment edges
57 connection edges
58 end faces
59 weld seams
60 arrow

The invention claimed is:

1. A thin-walled cold formed lightweight sectional element having an elongated section body (2) in which a plurality of openings (5) are formed, wherein the section body (2) includes at least two separately formed longitudinal portions (10, 11);

wherein each longitudinal portion (10, 11) includes a meandering longitudinal edge (12, 13);

wherein the longitudinal portions each include an elongated portion (16, 17) as well as a plurality of connection portions (14, 15, 23, 24, 37, 38, 45, 46, 47, 48) which project laterally beyond the elongated portion (16, 17) and which are bordered by the meandering longitudinal edge (12, 13);

wherein the connection portions (14, 23, 37, 45, 47) of the one longitudinal portion (10) face the connection portions (15, 24, 38, 46, 48) of the other longitudinal portion (11) and are welded to them end-to-end in each case or are connected to one another along bent-over abutment edges (56);

wherein the openings (5) are bordered at least regionally by portions of the meandering longitudinal edges (12, 13);

wherein stiffening beads (31) extending in the longitudinal direction of the longitudinal portions (10, 11) as well as stiffening beads (30) extending transverse thereto are formed in the longitudinal portions (10, 11);

wherein the transverse extending stiffening beads (30) are in communication with the stiffening beads (31) extending in the longitudinal direction; and wherein the transverse extending stiffening beads (30) extend into the connection portions (14, 15, 23, 24, 37, 38, 45, 46, 47, 48) and beyond the weld seams between the connection portions (14, 15, 23, 24, 37, 38, 45, 46, 47, 48).

2. A thin-walled cold formed lightweight sectional element in accordance with claim 1, wherein the connection portions (14, 15, 23, 24, 37, 38, 45, 46, 47, 48) of the two longitudinal portions (10, 11) each include connection edges (20, 21) or bent-over abutment edges (56) which are adjacent to one another and extend substantially parallel to one another.

3. A thin-walled cold formed lightweight sectional element in accordance with claim 1, wherein the connection edges (20, 21) extend substantially parallel, perpendicular or oblique and the bent-over abutment edges (56) extend substantially parallel to the longitudinal extent of the longitudinal portions (10, 11).

4. A thin-walled cold formed lightweight sectional element in accordance with claim 1, wherein the connection portions (14, 15, 23, 24, 37, 38, 45, 46, 47, 48) are T-shaped, web-shaped, trapezoidal shaped or triangular or include hexagonal regions.

5. A thin-walled cold formed lightweight sectional element in accordance with claim 1, wherein a respective one connection portion (14, 15, 23, 24, 37, 38, 45, 46, 47, 48) of the one longitudinal portion (10, 11) is disposed opposite a connection portion (14, 15, 23, 24, 37, 38, 45, 46, 47, 48) of the other longitudinal portion (10, 11).

6. A thin-walled cold formed lightweight sectional element in accordance with claim 1, wherein the connection portions (14, 15, 23, 24, 37, 38, 45, 46, 47, 48) are arranged alternating in the longitudinal direction of the sectional element (1).

7. A thin-walled cold formed lightweight sectional element in accordance with claim 1, wherein the longitudinal portions (10, 11) have a thickness of approximately between 0.5 mm and 3 mm.

8. A thin-walled cold formed lightweight sectional element in accordance with claim 1, wherein the weld connection between the connection portions (14, 15, 23, 24, 37, 38, 45, 46, 47, 48) is made as a discontinuous laser weld seam.

9. A thin-walled cold formed lightweight sectional element in accordance with claim 1, wherein a stiffening bead (31) formed in a longitudinal portion (10, 11) and extending in the longitudinal direction is connected via one or more of the transverse extending stiffening beads (30) to a stiffening bead (31) formed in the other longitudinal portion (10, 11) and extending in the longitudinal direction.

10. A thin-walled cold formed lightweight sectional element in accordance with claim 1, wherein the stiffening beads (31) extending in the longitudinal direction extend over the whole length of the respective longitudinal portion (10, 11) or are interrupted once or a multiple of times.

11. A thin-walled cold formed lightweight sectional element in accordance with claim 1, wherein the material of the section body (2) bordering the openings (5) is deep drawn.

12. A thin-walled cold formed lightweight sectional element in accordance with claim 1, wherein the edges of the section body (2) bordering the openings (5) are bent over.

13. A thin-walled cold formed lightweight sectional element in accordance with claim 12, wherein the edges of the section body (2) bordering the openings (5) are made as flanged edges.

14. A method for manufacturing a thin-walled cold formed lightweight sectional element having an elongated section body (2) in which a plurality of openings (5) are formed, the method comprising the steps of:

providing two separate longitudinal portions (10, 11) each having a meandering longitudinal edge (12, 13) to produce the section body (2), with the longitudinal portions (10, 11) in each case including an elongated portion (16, 17) as well as a plurality of connection portions (14, 15, 23, 24, 37, 38, 45, 46, 47, 48) which project laterally beyond the elongated portion (16, 17) and which are bordered by the meandering longitudinal edge (12, 13);

moving apart the longitudinal portions (10, 11) transverse to their longitudinal extent; and welding the connection portions (14, 23, 37, 45, 47) of the one longitudinal portion (10) to the connection portions (15, 24, 38, 46, 48) of the other longitudinal portion (11) end-to-end so that the openings (5) are formed between portions of the meandering longitudinal edges (12, 13);

forming stiffening beads (31) extending in the longitudinal direction of the longitudinal portions (10, 11) as well as forming stiffening beads (30) extending transverse thereto in the longitudinal portions (10, 11), with the transverse extending stiffening beads (30) being in communication with the stiffening beads (31) extending in the longitudinal direction and the transverse extending stiffening beads (30) extending into the connection portions (14, 15, 23, 24, 37, 38, 45, 46, 47, 48) and beyond the weld seams between the connection portions (14, 15, 23, 24, 37, 38, 45, 46, 47, 48).

15. A method in accordance with claim 14, wherein, during the step of moving apart, the longitudinal portions (10, 11) are moved apart substantially perpendicular or oblique to their longitudinal extent.

16. A method in accordance with claim 14, comprising the further step of:

mutually displacing the longitudinal portions (10, 11) substantially in the longitudinal direction in addition to the moving apart of the longitudinal portions (10, 11) transverse to their longitudinal extent.

17. A method in accordance with claim 16, wherein the longitudinal displacement of the longitudinal portions (10, 11) takes place before, after or simultaneously with the step of moving apart of the longitudinal portions (10, 11) transverse to their longitudinal extent.

18. A method in accordance with claim 14, comprising the further step of:

introducing at least one meandering slit (9) which extends in the longitudinal extent of the starting material (6) into at least one elongated strip-shaped starting material (6) and divides the starting material (6) into at least two separate longitudinal portions (10, 11).

19. A method in accordance with claim 14, wherein the connection portions (14, 15, 23, 24, 37, 38, 45, 46, 47, 48) are connected to one another by laser welding.

* * * * *